US006027299A

United States Patent [19]

Williams

[11] Patent Number: 6,027,299

[45] Date of Patent: Feb. 22, 2000

[54] ADAPTER AND METHOD FOR EMPTYING REAR END LOADING WASTE CONTAINERS USING FRONT LOADING WASTE VEHICLES

[75] Inventor: Richard T. Williams, Clarendon Hills, Ill.

[73] Assignee: Kann Manufacturing Corporation, Guttenberg, Iowa

[21] Appl. No.: 09/001,283

[22] Filed: Dec. 31, 1997

[51] Int. Cl.[7] ..... B65F 3/04

[52] U.S. Cl. ..... 414/408; 414/406; 414/810

[58] Field of Search ..... 414/406, 408, 414/810, 407

[56] References Cited

U.S. PATENT DOCUMENTS

| | | | |
|---|---|---|---|
| 2,738,222 | 3/1956 | Needham . | |
| 2,807,383 | 9/1957 | Scheltens . | |
| 2,824,658 | 2/1958 | Beasley . | |
| 2,828,032 | 3/1958 | Beasley et al. . | |
| 3,013,684 | 12/1961 | King et al. . | |
| 3,015,401 | 1/1962 | Bergstrom . | |
| 3,207,345 | 9/1965 | Ord | 414/406 |
| 3,613,924 | 10/1971 | Monson . | |
| 3,661,285 | 5/1972 | Appleman . | |
| 3,713,556 | 1/1973 | Tredray . | |
| 3,752,346 | 8/1973 | Thompson et al. . | |
| 3,790,011 | 2/1974 | Owen, Jr. . | |
| 3,797,684 | 3/1974 | Brandt . | |
| 3,809,270 | 5/1974 | Peltonen . | |
| 4,613,271 | 9/1986 | Naab . | |
| 4,687,405 | 8/1987 | Olney | 414/408 |
| 5,074,737 | 12/1991 | Pellegrini et al. | 414/406 |
| 5,266,000 | 11/1993 | LeBlanc, Jr. . | |
| 5,433,493 | 7/1995 | Dix et al. . | |

FOREIGN PATENT DOCUMENTS

| | | | |
|---|---|---|---|
| 2523186 | 10/1975 | Germany | 414/406 |
| 149850 | 8/1981 | Germany | 414/406 |

*Primary Examiner*—Thomas J. Brahan
*Attorney, Agent, or Firm*—Foley & Lardner

[57] ABSTRACT

An adapter for use with a front end loading waste vehicle allows conventional rear end loading waste containers to be picked-up and emptied. The adapter allows a single waste vehicle to empty both front end loading and rear end loading waste containers one after the other in a common area during a single pick-up route.

7 Claims, 3 Drawing Sheets

ADAPTER AND METHOD FOR EMPTYING REAR END LOADING WASTE CONTAINERS USING FRONT LOADING WASTE VEHICLES

BACKGROUND OF THE INVENTION

This invention relates to mechanical adapters that allow conventional front end loading waste vehicles to pick-up and empty rear end loader waste containers.

There are basically three types of waste collection vehicles; front-end loaders, rear end loaders and side loaders. Our invention concerns adapters for use with front-end loading vehicles. The front end loading vehicles typically pick-up and empty large "front end loader" (FEL) waste containers used by businesses and apartment complexes. Typically, this is accomplished by engaging two forks of the front loader into channels built into the sides of the FEL waste container and lifting the FEL container up and over the top of the vehicle, thus emptying the waste into the hopper of the vehicle. There are also residential front-end loader vehicles that do not contain front forks and which are designed to pick-up and empty residential waste carts and small commercial containers. In contrast, rear end loading waste vehicles pick-up and empty large waste containers of a completely different design known as "rear end loader" (REL) waste containers used by businesses and apartment complexes. Common to these REL containers is a trunion bar that runs across the top front portion of the container and extends outwardly on each side to form two ends. These containers may be single compartment or multi-compartment containers. Single compartment containers are used to collect mixed wastes or a single type of waste, such as cardboard. Multi-compartment containers are used to collect recyclable wastes, such as paper, plastic, fiber and/or glass. To empty a REL container, a rear end loader truck is positioned so that the lower back-end of the truck engages each end of the trunion, then a cable from the rear of the truck is connected to the top rear portion of the REL container. In the typical situation, a motorized wrench on the truck then pulls and lifts the REL container off the ground, while the front of the container pivots about the trunion and empties the contents into the rear of the truck. Alternatively, there exist rear end loader vehicles that use a hydraulic lifting apparatus to lift and rotate the container into the dumping position.

Unfortunately, existing front end loading waste vehicles have no mechanism to allow for emptying of REL waste containers and likewise, rear end loading waste vehicles cannot empty FEL waste containers. As such, waste hauling and disposal companies are forced to maintain a large inventory of both types of waste vehicles and an equally large inventory of FEL and REL containers. Clearly, there is a need for some type of apparatus, which enables at least one type of waste vehicle to empty the other type of waste container.

Accordingly, it is an object of our invention to provide a device, which increases the versatility and productivity of a front end loading waste vehicle. Another object of our invention is to provide an adapter that enables a front end loading waste vehicle to lift both conventional FEL and REL waste containers. Yet another object is to provide a method where an adapter is used by a front end-loading vehicle to pick-up and empty a REL waste container. Other objects will be apparent to one skilled in the art of waste collection upon reading the following disclosure.

SUMMARY OF THE INVENTION

Our invention relates to various designs of an adapter for use with front end loading vehicles. The adapter of our invention enables the lifting assembly of a conventional front end-loading vehicle to pick-up and empty REL waste containers.

The adapter of our invention comprises two trunion capture plates, a waste container stop and a waste container stabilizer. In an alternative embodiment of our invention the adapter comprises two movable trunion capture plates pivotally connected to the rear portion of the front forks of a front end loading waste vehicle. In this embodiment, each trunion capture plate includes a container stop and the crossbeam of the front fork assembly has attached a container stabilizer.

The method of picking-up and emptying the REL container involves positioning the lifting assembly of a front end loading vehicle in close proximity to a REL container so that the trunion on the REL container is located near the crossbeam of the lifting assembly. Once the waste vehicle and REL container are in the proper position, the trunion capture plates are used to engage the two ends of the trunion on the REL container. The container stabilizer then comes into bearing contact with the lower front portion of the container to provide support during lifting. In one embodiment, the container stabilizer is manipulated pneumatically or hydraulically to position it under the front of the REL container. Next, the hydraulic arms of the front end-loading vehicle are then raised, thus raising the front forks, which in turn raises the adapter. The lower front portion of the container is supported by and in bearing contact with the container stabilizer. Because the adapter and its trunion capture plates are in communication with the REL container, the container is also raised and lifted up and over the top of the vehicle. The crossbeam is then pivoted, which causes the stabilizer in bearing contact with the container to rotate toward the hopper opening, thus causing the REL container to rotate about the trunion. As the container rotates about its trunion and within the trunion capture plates, the container comes in contact with the container stop. The container stop prevents or limits further rotation of the container, thus maintaining the container in a predetermined inverted position over the top of the waste vehicle hopper. This allows the container to dump its contents into the hopper opening located on the top of the waste vehicle that is directly connected to one or more waste-receiving compartments of the vehicle. The container is then lowered and returned to the starting ground position.

DETAILED DESCRIPTION OF THE INVENTION

Figure 1:
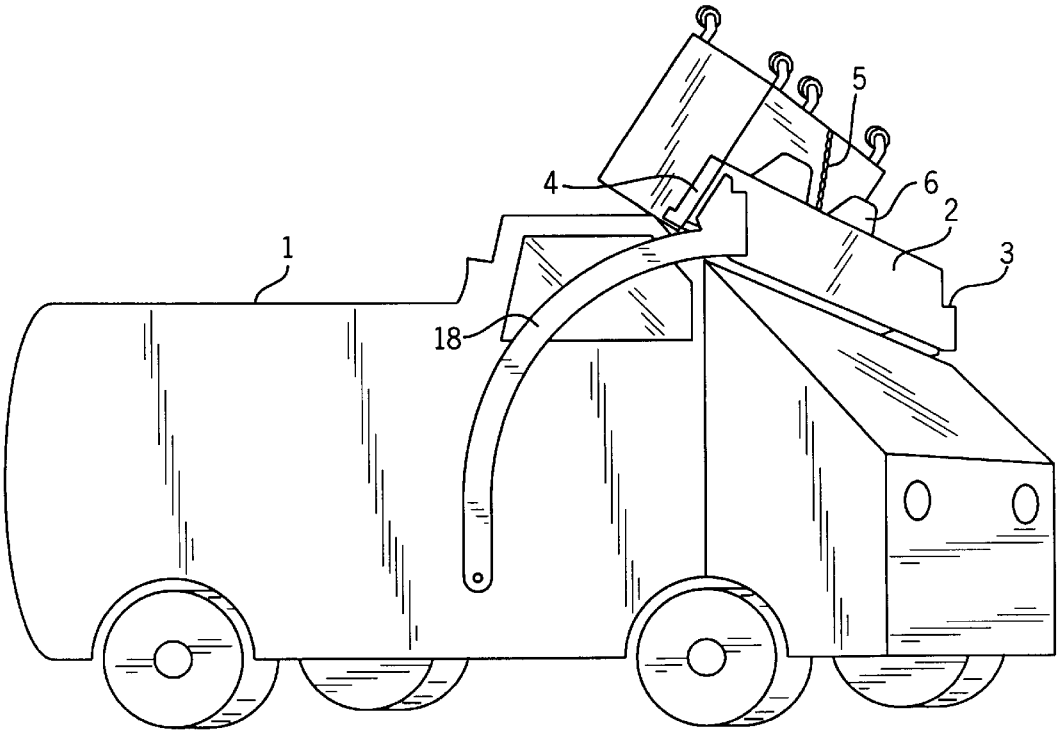
FIG. 1 is a perspective view of one embodiment of the adapter of this invention attached to a front loading vehicle engaging one type of REL waste container.

FIG. 1 illustrates one embodiment of our adapter designed to be attached to a residential front end loader 1 having a lifting assembly 3 containing a crossbeam 2 and hydraulic arms 18. The adapter comprises trunion capture plates 4, a waste container stabilizer 6 and container stop 5. The container stabilizer can be any bearing surface that is capable of supporting the lower front portion of the REL waste container. Likewise, the container stabilizer can be stationary as shown in FIG. 1 or be movable by use of hydraulic or pneumatic pistons. The purpose of the stabilizer is to provide a support surface to allow the container to be lifted when the lifting apparatus rotates up and over the top of the vehicle. Without the stabilizer, the container would swing about its trunion engaged in the trunion capture plates in a downward, clockwise direction. The container stop 5, even though shown in FIG. 1 as a chain or cable device, can be any mechanical structure or assembly that stops or maintains the REL container in a predetermined position.

Figure 2:
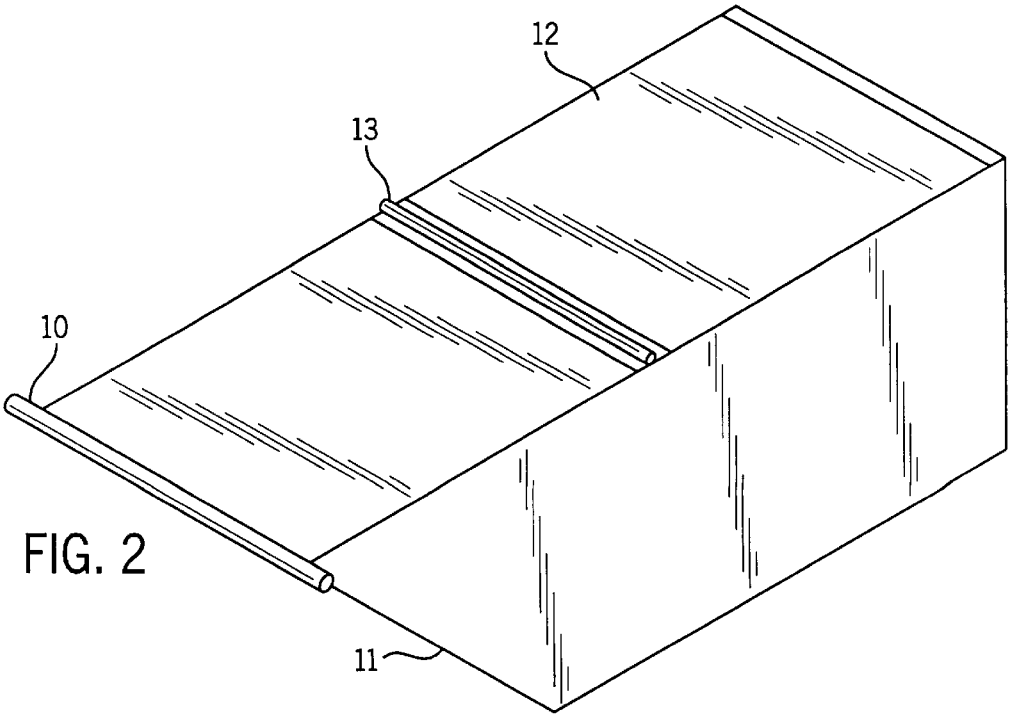
FIG. 2 is a perspective view of another type of conventional REL waste container.
Figure 3:
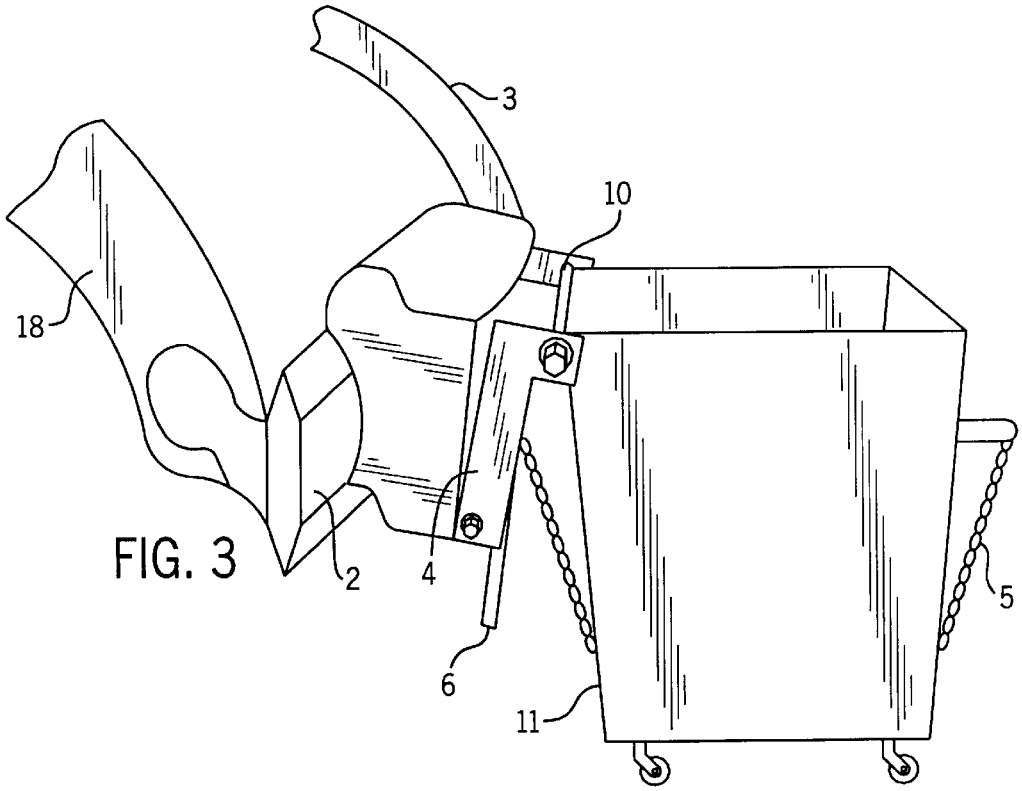
FIG. 3 is a close-up side view of one embodiment of the trunion capture plate engaged with a trunion.

A conventional REL waste container is illustrated in FIG. 2. Common to all REL containers is a trunion 10 that extends across the top front-end portion of the container and extends outwardly to form two ends. Typically, the REL container contains one or two lids 12 connected to the container through hinge 13. The front end 11 of the waste container is positioned in close proximity to the crossbeam 2 as illustrated in FIG. 3 in order that trunion capture plates 4 can engage the trunion 10. Although FIG. 2 shows a specific design or style of REL container, any shape container with or without lids, will work with our adapter, provided that the container has a trunion and its width does not exceed the width of the crossbeam of the lifting assembly or the distance between the trunion capture plates.

The trunion capture plates can be designed in a variety of ways so long as they are capable of engaging the two ends of the trunion and allow the trunion to rotate freely when the container is raised up and over the top of the waste vehicle during the dumping cycle. In its simplest design, the trunion capture plate may just a rigid plate with holes that are slightly larger in diameter that the outside diameter of the trunion. Alternatively, the trunion captures plates can be of a complicated design have several mechanical parts and using hydraulic or pneumatic pistons to operate one or more of those parts. For example, the trunion capture plate may be comprised of one part that is U shaped to receive the trunion when the vehicle is moved into position up against the front end of the container. Once the trunion is in the U shaped receiving portion, a locking part can be swung into position to lock the trunion into the trunion capture plate.

In practice, as shown in FIG. 3, the front loading waste vehicle 1 has the adapter attached to the lifting assembly. With the adapter in position, the waste vehicle can then pick-up and empty any conventional REL containers of a similar design to that shown the type illustrated in FIG. 2. This is accomplished by maneuvering the waste vehicle so that the lifting assembly with the adapter attached is in close proximity to the front portion 11 of the REL container to allow the two ends of the trunion to be engaged by the trunion capture plates. Container stop 5 can now be positioned over the top portion of the waste container. In a design where a chain or cable device is used as the container stop, it is wrapped around the container and secured to the lifting assembly. With trunion 10 in position, lifting of the container can then commence. Once this begins, the container stabilizer 6 will engage the lower front portion of the container. The container can now be picked up and emptied. This is accomplished by operating the hydraulic arms of the waste vehicle in a known manner, the same as if an FEL waste container or residential waste carts were engaged on the lifting assembly. Since the crossbeam is attached to the hydraulic arms and the adapter is attached to the crossbeam, the REL container is lifted off the ground and raised to an elevated position over the waste vehicle. The crossbeam is then rotated, thus rotating the waste container toward the hopper. Container stop 5 stops or prevents the container from excessive rotation. Once the container has rotated to a point that it is upside down over the top of the vehicle, the waste pushes lid 12 open and falls into the hopper opening located on the top of the vehicle. As previously discussed above, there are a variety of REL container designs that will work with our adapter.

Figure 4:
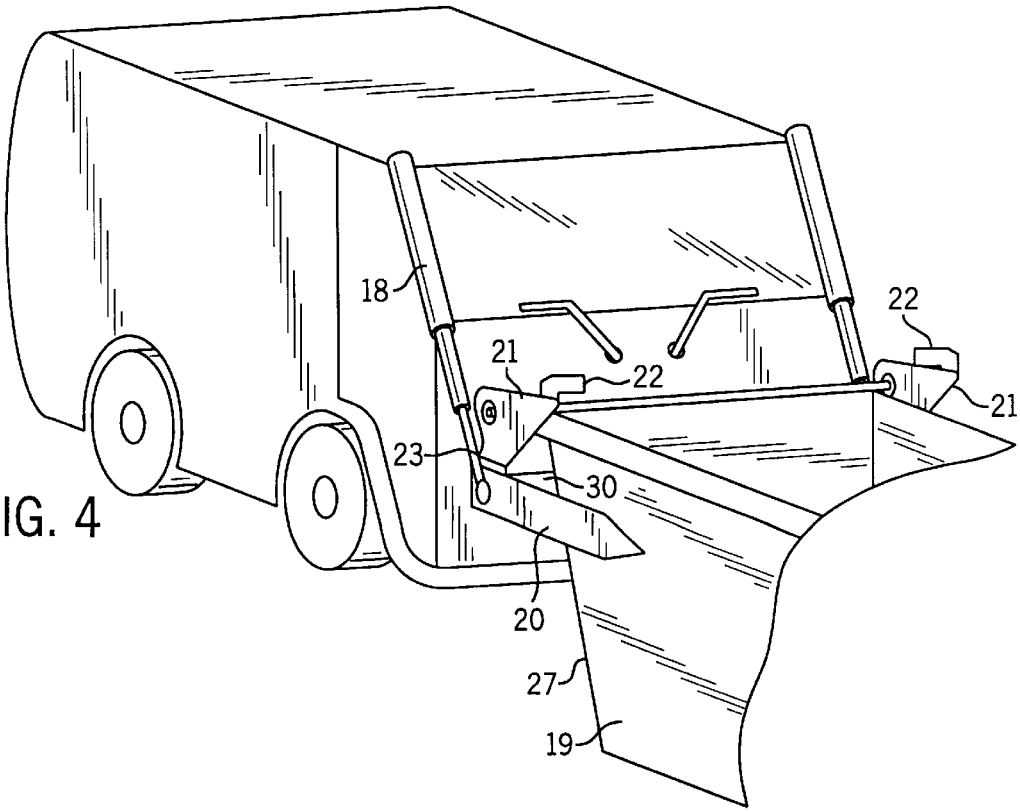
FIG. 4 is a perspective view of the adapter attached to a waste vehicle and engaging a REL waste container.
Figure 5:
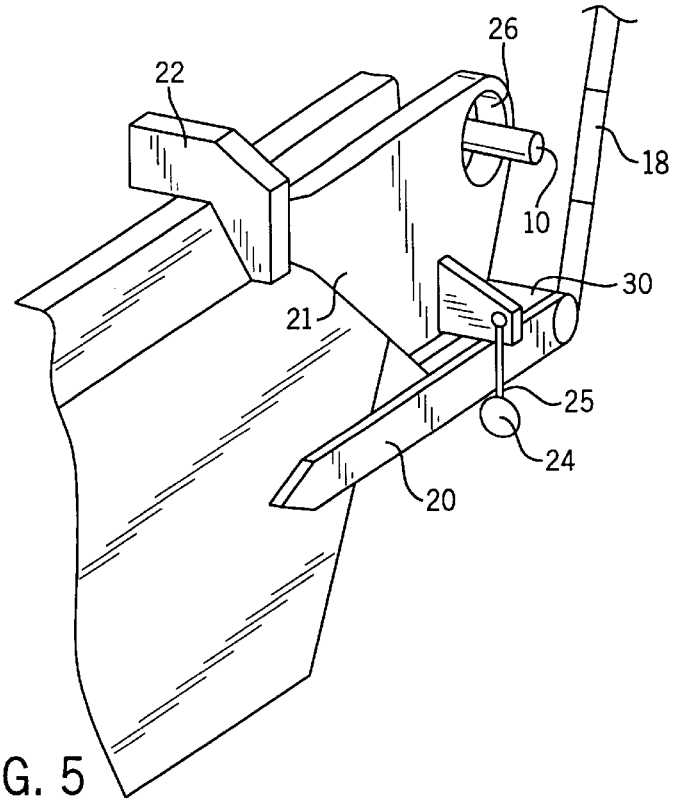
FIG. 5 is a close-up perspective view of another embodiment of the trunion capture plate engaged on a REL waste container.
Figure 6:
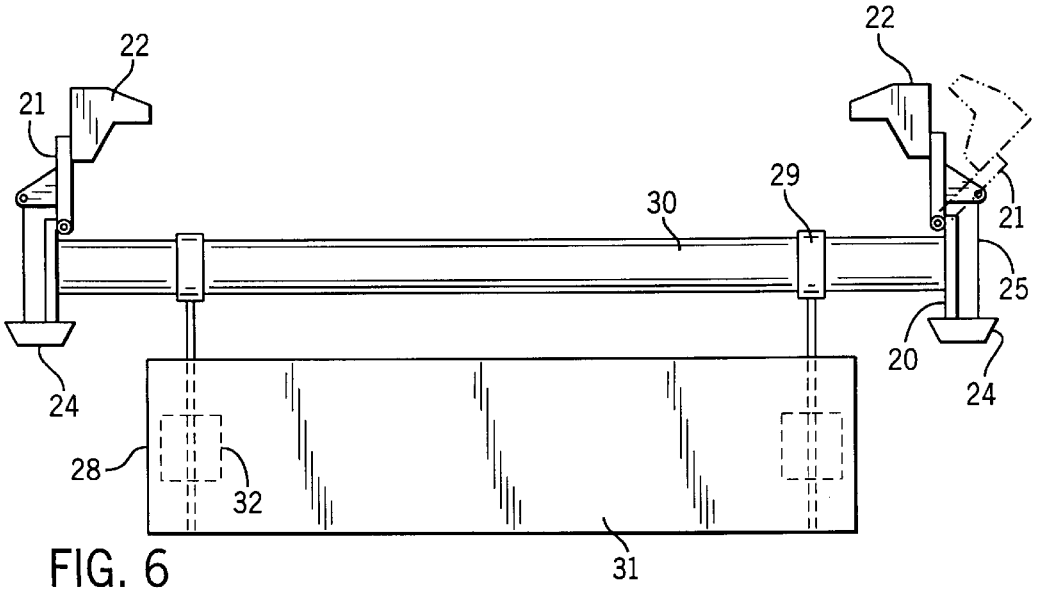
FIG. 6 is a close-up view of the container stabilizer.

In another embodiment of our invention, we have designed an adapter to accomplish the same task except that the trunion capture plates of the adapter are attached to the front forks of a front end loading waste vehicle used primarily to pick-up and empty FEL waste containers. This is illustrated in FIGS. 4–6. With this design, the same waste vehicle can pick-up and empty conventional FEL waste containers, as well as REL waste containers. Thus, a single waste collection vehicle during a single route can service both types of containers without adding or removing from the vehicle any additional lifting components associated with the vehicle. This adapter design comprises two movable trunion capture plates 21 which are pivotally connected to the upper edge of each front fork 20 through hinge 23. The front forks 20 are in turn connected to crossbeam 30, which in turn is connected to hydraulic arms 18 of the waste vehicle. In some instances the crossbeam can be rotated by a mechanical linkage even though the arms are rotated using hydraulic pistons.

Prior to engaging REL container 19, trunion capture plates 21 are positioned outwardly as shown by the dashed phantom lines in FIG. 6. Trunion capture plates 21 are moved into position by either a well known hydraulic or pneumatic mechanism 24 pivotally connected through pin connection 25. Trunion capture plates 21 each contain at least one cut-out 26 of a diameter sufficiently large enough to capture the ends of trunion 10 as shown in FIG. 5. One or both trunion capture plates can also have attached a container stop 22. These stops perform the same function as the cable or chain device described above, that being to stop or prevent over rotation of the container toward the hopper about the trunion with in the trunion capture plates when the container is rotated by the lifting apparatus over the top of the vehicle.

FIG. 6 illustrates another embodiment of the waste container stabilizer. In this design the waste container stabilizer 28 is pivotally attached 29 to crossbeam 30. Crossbeam 30 is part of the lifting assembly of the waste vehicle and connects the front forks 20 to hydraulic arms 18. Container stabilizer 28 comprises plate 31, which is positioned to be in bearing contact with the lower front portion 27 of waste container 19. Stabilizer plate 31 is held in bearing contact with container 19 by operation of any conventional and well-known pneumatic or hydraulic mechanism, shown in FIG. 6 as a pneumatic bellows 32.

The method used to pick-up and empty a REL container using the adapter design for a vehicle having front forks is basically the same as that described above. With the adapter design shown in FIGS. 4–6, once the REL container is in position between front forks 20, the trunion capture plates 21 are swung, moved or otherwise slightly rotated until the cut-outs 26 surround and capture the ends of trunion 10, thus securing the waste container to the vehicle. Likewise, the container stabilizer 28 is moved into bearing contact with the front lower portion of the REL container 19. The lifting and emptying of the container involves the same operation as that used in picking-up and emptying a conventional FEL loader container.

Of course, as evident from the foregoing descriptions, only certain preferred embodiments of our invention have been described. Various modifications may be made in the adapter of our invention without departing from the scope and spirit of the invention. In addition, one of ordinary skill in the art will appreciate the conventional operation of the various pneumatic and hydraulic mechanism needed to operate the hydraulic arms and front forks on the waste vehicle, as well as the pressure levels needed to manipulate the various mechanical structures described.

We claim:

1. A refuse collection vehicle for loading refuse from a first loading container having a floor, a front wall, a rear wall, first and second side walls and first and second channels along the first and second side walls and also from a rear loading container having a floor, a front wall, a rear wall, first and second side walls and a trunnion having first and second end portions extending beyond the first and second side walls, respectively, a vehicle comprising:

a chassis;

a storage body supported by the chassis, the storage body having an interior and a roof above the interior providing an opening into the interior;

first and second lift arms pivotably coupled to the chassis;

a cross member extending between the first and second lift arms;

first and second forks extending from the cross member and configured to be positioned within the first and second channels;

at least one support arm configured to engage the rear wall of the front loading container and the rear wall of the rear loading container;

at least one movable member adapted for movement between a first trunnion encircling position and a second trunnion non-encircling position; and at least one movable container stop adapted for movement between an extended position in which the stop engages an upper edge of one of the first and second side walls of the rear loading container and a retracted position so as to permit the first and second forks to be positioned within the first and second channels.

2. The vehicle of claim 1 including an actuator coupled to the at least one movable container stop moving the at least one container stop between the extended position and the retracted position.

3. The vehicle of claim 1 wherein the at least one movable container pivots about an axis parallel to the first side wall.

4. A refuse collection vehicle for loading refuse from a container having a floor, a front wall, a rear wall, first and second side walls having first and second upper edges, respectively, and at least one trunnion proximate the rear wall, the trunnion having first and second end portions extending beyond the first and second side walls, respectively, the vehicle comprising:

a chassis with a cab;

a storage body supported by the chassis;

first and second lift arms pivotably coupled to the chassis;

a cross member extending between the first and second lift arms;

at least one support arm configured to engage the rear wall of the container;

at least one movable member adapted for movement between a first trunnion encircling position and a second trunnion non-encircling position; and at least one container stabilizer extending from the cross member and configured to engage at least one of the upper edge of the first side wall, the upper edge of the second side wall and the front wall, for stabilizing the container while lifting it over the cab.

5. The vehicle of claim 4 wherein the container stabilizer is adapted to be connected to the front wall of the container.

6. The vehicle of claim 4 wherein the container stabilizer is adapted to abut the upper edge of at least one of the first and second side walls.

7. A method of picking up and emptying a refuse container having a floor, a front wall, a rear wall, first and second side walls having first and second upper edges, respectively, and at least one trunnion having first and second end portions extending beyond the first and second side walls, respectively, the method comprising:

providing a refuse collection vehicle having at least one waste collection compartment having a roof with a load opening therethrough, a lifting assembly including a cross member connected to hydraulic arms, at least one movable member adapted for movement between a first trunnion encircling position and a second trunnion non-encircling position, at least one support arm configured to engage the rear wall of the container and at least one movable container stop adapted for movement between a retracted position and an extended position in which the stop engages at least one of the upper edge of the first side wall, the upper edge of the second side wall and the front wall;

moving the at least one movable member to the first trunnion encircling position;

moving the at least one support arm into engagement with the rear wall of the container;

moving the at least one container stop into engagement with at least one of the upper edge of the first side wall, the upper edge of the second side wall and the front wall of the container; and pivoting the hydraulic arms to lift and at least partially invert the container over the roof of the waste collection compartment and in at least partial alignment with the load opening.

* * * * *